US005891829A

United States Patent [19]

Vallejos et al.

[11] Patent Number: 5,891,829

[45] Date of Patent: Apr. 6, 1999

[54] PROCESS FOR THE DOWNHOLE UPGRADING OF EXTRA HEAVY CRUDE OIL

[75] Inventors: Carlos Vallejos, Los Tegus; Tito Vasquez, San Antonio; Cesar Ovalles, Caracas, all of Venezuela

[73] Assignee: Intevep, S.A., Caracas, Venezuela

[21] Appl. No.: 910,063

[22] Filed: Aug. 12, 1997

[51] Int. Cl.[6] ..... C09K 3/00; F21B 43/16

[52] U.S. Cl. ..... 507/202; 166/305.1

[58] Field of Search ..... 507/202, 102; 166/305.1

[56] References Cited

U.S. PATENT DOCUMENTS

| | | | |
|---|---|---|---|
| 4,280,559 | 7/1981 | Best | 166/305.1 |
| 4,687,570 | 8/1987 | Sundaram et al. | 208/431 |
| 4,957,646 | 9/1990 | Borchardt et al. | 507/202 |
| 5,025,863 | 6/1991 | Haines et al. | 166/305.1 |
| 5,105,887 | 4/1992 | Hewgill et al. | 507/202 |
| 5,269,909 | 12/1993 | Ovalles et al. | 208/370 |
| 5,424,285 | 6/1995 | Stacy et al. | 507/202 |
| 5,725,054 | 3/1998 | Shayegi et al. | 166/305.1 |

*Primary Examiner*—Philip Tucker

*Attorney, Agent, or Firm*—Bachman & LaPointe, P.C.

[57] ABSTRACT

A down hole hydroconversion process improves the viscosity, API gravity, and distillate proportions of heavy crude oils by employing a hydrogen donor, methane and steam down hole wherein the mineral formation down hole acts as a catalyst for the hydroconversion process.

9 Claims, 4 Drawing Sheets

PROCESS FOR THE DOWNHOLE UPGRADING OF EXTRA HEAVY CRUDE OIL

BACKGROUND OF THE INVENTION

The present invention is drawn to a process for improving the viscosity of a crude oil down hole in a well and, more particularly, a down hole hydroconversion process employing the mineral formation of the well as a catalyst for the hydroconversion process. Upon distillation of the improved crude oil, an increase in distillate proportion is realized.

It is highly desirable to improve the properties of heavy crude oil, especially to substantially reduce their viscosity and increase their distillate proportion, in light of the large availability of heavy crude oils, for example, in the Orinoco Belt of Venezuela. It is highly desirable to improve the properties of heavy crude oil down hole in situ in the well formation as same will lead to not only improve the crude oil properties but assist in increasing crude oil production from the well formation.

There are known in the prior art various processes for treating hydrocarbon materials using hydrogen, methane and nitrogen in order to improve the properties thereof. Most of these processes are not entirely satisfactory on a commercial scale. One such process is disclosed in U.S. Pat. No. 4,687,570 which deals with the liquification of coal in the presence of a methane atmosphere. A superior process for treating heavy crude oils is disclosed in U.S. Pat. No. 5,269,909 assigned to the assignee of the instant application. A process is disclosed therein which improves viscosity and the distillate proportion of the hydrocarbons.

It is highly desirable to provide a process for improving the properties of crude oil down hole in the well formation. By providing a process down hole, crude oil production is increased along with the quality of the crude oil product.

Accordingly, it is the principal object of the present invention to provide a down hole hydroconversion process.

It is a particular object of the present invention to provide a down hole conversion process for improving the viscosity of crude oils.

It is a further object of the present invention to provide a hydroconversion process for improving crude oil viscosity down hole which employs mineral content of the well formation as a catalyst for the hydroconversion a process.

It is further object of the present invention to provide a process as aforesaid which is relatively inexpensive to carry out when compared to above ground hydroconversion processes.

Further objects and advantages of the present invention will appear hereinbelow.

SUMMARY OF THE INVENTION

In accordance with the present invention, it has now been found that foregoing objects and advantages may be readily obtained.

The process of the present invention comprises a down hole hydroconversion process for improving the crude oil viscosity in a well formation wherein the well formation itself is employed as a catalyst for the hydroconversion process. Upon distillation of the improved crude oil, an increase in distillate proportion is realized. The process comprises the steps of analyzing the well formation to determine (1) the concentration of crude oil in the well with respect to the mineral formation and (2) the amount of methane present in the well. The amount of methane present in the well is determined with respect to the concentration of the crude oil. Thereafter a mixture comprising steam, a hydrogen donor for the crude oil, and if necessary methane, is fed down hole to the well in an amount sufficient to obtain a hydrogen donor concentration of at least about 0.15 moles per kg of crude oil, a methane concentration of at least about 0.40 moles per kg of crude oil, and a sufficient amount of steam so as to raise the temperature of a well to at least 175° C. so as to initiate a hydroconversion process down hole in the presence of the hydrogen donor, the methane, the steam and the mineral formation of the well formation so as to produce an upgraded crude oil.

In accordance with the present invention, the mineral formation contains between about 50 to 90 wt % quartz, between 1.4 to 10.5 wt % iron, between 1 to 15 wt % aluminum and between 1 to 15 wt % calcium. The mineral formation acts as a catalyst for the hydroconversion process.

In accordance with the process of the present invention the viscosity of crude oil is reduced, the amount of lower boiling point fractions is increased, and the API gravity is greatly improved.

Further advantages and features of the present invention will appear hereinbelow.

BRIEF DESCRIPTION OF THE DRAWING

The present invention will be described from a consideration of the following drawings wherein.

DETAILED DESCRIPTION

Figure 1:
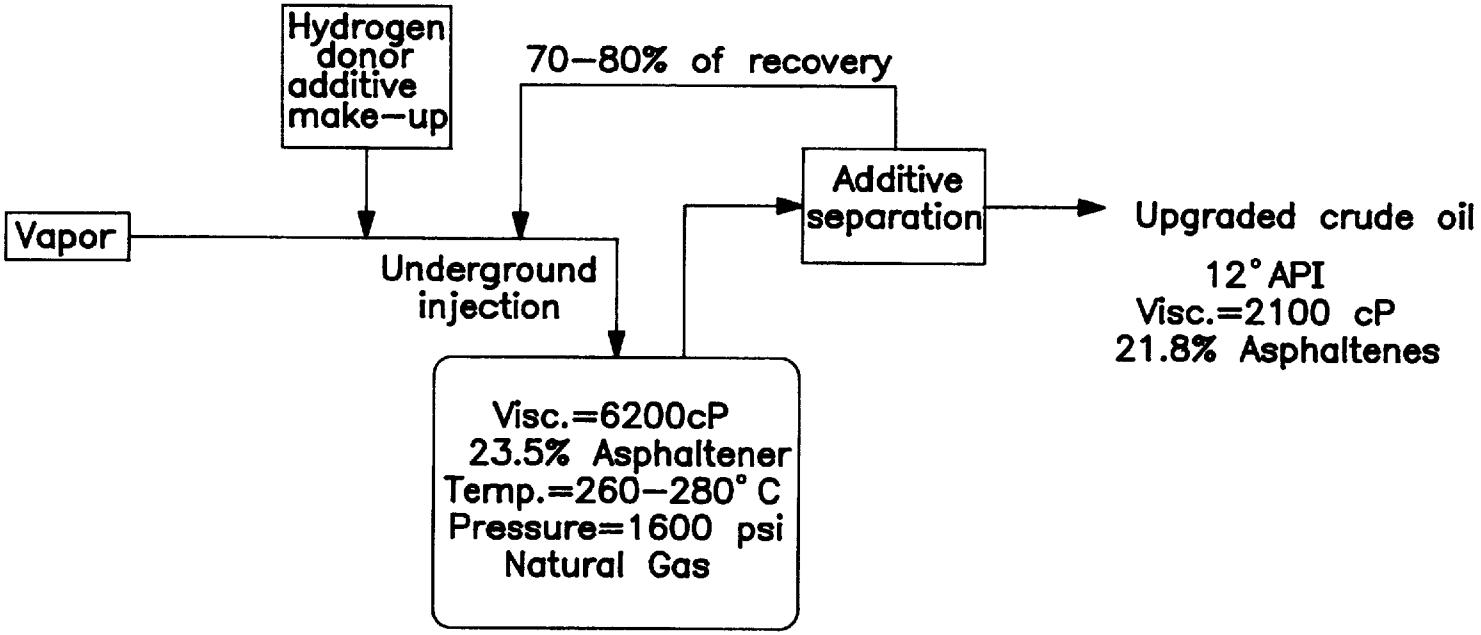
FIG. 1 is a schematic illustration of the process of the present invention.

The process of the present invention obtains improved viscosity and improved distillate proportions obtained from heavy crude oils.

The down hole conversion process of the present invention is particularly useful for heavy crude oils found in the Orinoco Belt of Venezuela. These crude oils are characterized by heavy API gravities, high pour points, high viscosities and high contents of sulphur, metals, nitrogen and conradson carbon.

In accordance with the present invention the mineral formation of the well formation acts as a catalyst for the hydroconversion process. In order to be an effective catalyst, the mineral formation should have the following composition: from between about 50 to 90 wt % quartz, from between about 1.4 to 10.5 wt % iron, from between about 1 to 15 wt % aluminum, and from between about 1 to 15 wt % calcium. The iron is present in the form of an iron compound and preferably a compound selected from the group consisting of FeO, $Fe_2O_3$, $Fe_3O_4$, $Fe_2(SO_4)_3$ and mixtures thereof.

In order to carry out the hydroconversion process of the present invention down hole, it is necessary that the well formation have the mineral formation noted above and a sufficient amount of methane, hydrogen and heat so as to carry out the catalytic reaction. In accordance with the present invention it has been found that methane must be present in the minimal amount of at least about 0.40 moles per kg of crude oil in the well formation. The amount of methane is preferably between about 0.40 moles to about 500 moles of methane per kg of crude oil and, ideally, between about 1.0 moles to 50.0 moles of methane per kg of crude oil.

In addition to the foregoing, in order for the hydroconversion process to forward it is necessary that the process be carried out in the presence of a hydrogen donor for the crude oil. The hydrogen donor for the crude oil is preferably a naphtenic aromatic compound such as tetralin, alkylsubstituted tetralin, tetrahydroquinoline, alkylsubstituted hydroquinoline, 1,2-dihydronaphtalene, a distillate cut having at least 40 wt % naphtenic aromatic compounds Tetralin, alkylsubstituted tetralin and the distillate cut being most preferred. The hydrogen donor is added in an amount sufficient to assure a hydrogen content of at least about 0.15 moles per kg of crude oil, preferably an amount of between about 0.15 moles to 20.0 moles of hydrogen per kg of crude oil and, ideally, 1.12 moles to 12.0 moles of hydrogen per kg of crude oil.

Steam is necessary in the process of the present invention so as to provide sufficient heat to carry out the hydroconversion process down hole, and accordingly, steam is injected down hole into the well with the necessary methane and hydrogen donor so as to obtain a temperature down hole in the well of at least about 175° C., preferably a temperature of between 175° C. to 350° C. and ideally, between 280° C. and 320° C.

The process of the present invention is carried out as follows. A well formation is analyzed in order to determine (1) the concentration of crude oil in the well with respect to the mineral formation and (2) the amount of methane present in the well. Thereafter the amount of methane in the well is compared to the amount of methane sufficient to carry out a hydroconversion process. A mixture of methane, a hydrogen donor, and steam is thereafter fed down hole to the well formation so as to obtain a concentration of hydrogen donor in an amount of at least about 0.15 moles per kg of crude oil, a concentration of methane in an amount of at least about 0.40 moles per kg of crude oil, and sufficient steam to raise the temperature down hole of the well to at least 175° C. By feeding to the well formation the mixture as set forth above, the crude oil is subjected to a hydroconversion process in the presence of the hydrogen donor, the methane, the steam and the mineral formation so as to produce an upgraded crude oil having improved viscosity, API gravity, and lower boiling distillates.

As noted above the amount of methane fed to the well is such as to provide down hole in the well a methane concentration of between about 0.40 moles to 500 moles of methane per kg of crude oil, ideally between about 1.0 moles to 50.0 moles. The hydrogen donor concentration down hole in the well is between about 0.15 moles to 20.0 moles of hydrogen per kg of crude oil, ideally between about 1.12 moles to 12.0 moles. The steam is sufficient to raise the temperature of the well to at least 175° C., preferably between 175° and 350° C., and ideally between 280° and 320° C. By providing the necessary steam, hydrogen donor, and methane in the proper mineral well formation, the crude oil is improved in terms of viscosity and API gravity as well as distillate products.

The features of the present invention will be more clearly understood from the following illustrative examples.

EXAMPLE I

The effect of the mineral formation on the upgrading of crude oil was determined by carrying out laboratory experiments at conditions similar to those found down hole in a reservoir under steam injection conditions with and without the presence of the mineral formation. These experiments were carried out in a batch reactor without stirring with a final pressure of 1600 psi (initial pressure of $CH_4$=900 psi), 280° C. for 24 hours. Hamaca oil sands (wt % of crude oil=10 wt %), water and tetralin were allowed to react with a weight ratio of 10:1:1, respectively. The amounts of hydrogen available from the donor and methane used were 7.6 moles of hydrogen and 24 moles of $CH_4$ per Kg of crude oil. The composition of the sand used was 1 wt % dolomite, 1 wt % calcite, 4 wt % feldespate, 8 wt % clay and 86 wt % quartz. After the experiment was carried out, water and tetralin were separated from the oil sands by vacuum distillation at 300° C. The oil was removed from the sand by solvent extraction with a dichloromethane. The results of the experiments are shown in Table 1 below and in FIG. 1.

TABLE 1

Effects of the presence of mineral formation on the distilled fractions of the upgraded crude oil

| Fraction | With mineral formation | Without mineral formation |
|---|---|---|
| <350° C. | 10 | 4 |
| 350–500° C. | 38 | 25 |
| >500° C. | 52 | 61 |

As can be seen from Table 1 and FIG. 1, the mineral formation has a positive effect on the formation of lower boiling point fractions from a crude oil feedstock.

EXAMPLE II

Figure 2:
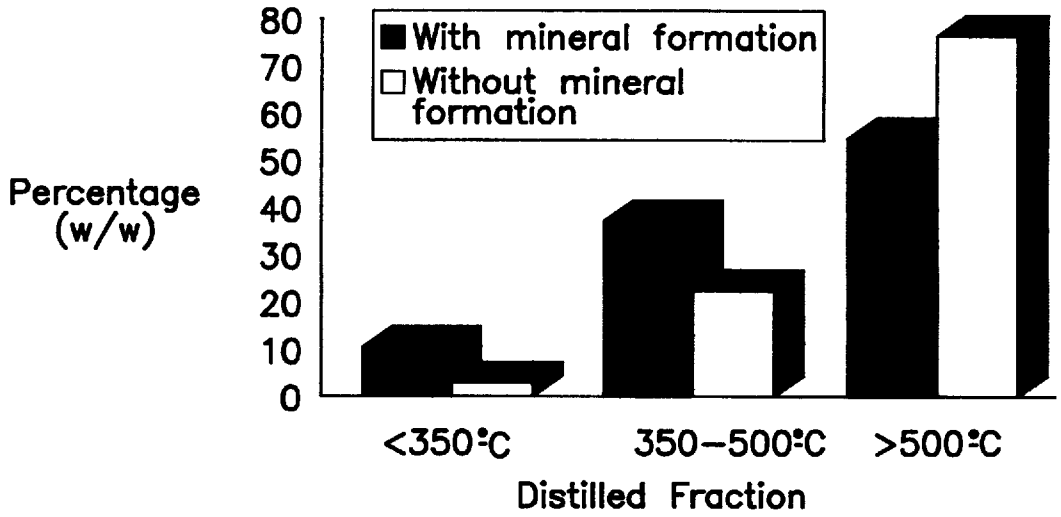
FIG. 2 is a graph which demonstrates the increase in lower boiling point fractions which result from the process of the present invention in the presence of the mineral formation.

This example demonstrates the effect of a hydrogen donor on the viscosity of the crude oil subjected to a down hole hydroconversion process in accordance with the present invention. The experiment was carried out under the same conditions as described in Example I in the presence of the mineral formation. The amount of the hydrogen donor was varied as reported in Table 2 below. The results of the experiment are set forth below in Table 2 and FIG. 2.

TABLE 2

Effects of the amount of hydrogen donor (tetralin) on the viscosity of the crude oil

| Wt % of Tetralin | Moles of hydrogexn per kg crude oil | Viscosity at 60° C. (in cP) |
|---|---|---|
| 0 | 0 | 6100 |
| 1 | 0.15 | 3700 |
| 5 | 0.76 | 1950 |
| 10 | 1.52 | 1940 |
| 20 | 3.03 | 1850 |
| 30 | 4.55 | 1600 |

Example II clearly demonstrates the positive effect of the hydrogen donor on crude oil viscosity.

EXAMPLE III

This example demonstrates the effect of methane on the viscosity of a crude oil subject to the down hole conversion process in accordance with the present invention. Again, the experiment was carried out under the same conditions as described in Example I above with nitrogen as a comparison and with and without the presence of methane (24 moles of $CH_4$ per kg of crude oil). The amount of hydrogen donor and material formation were as per Example I. The amount of methane was varied and the results are shown in Table 3 below and FIG. 3.

TABLE 3

Effects of the amount of methane on the viscosity (in cP) of the crude oil

| Temp. (°C.) of viscosity measurement (in cP) | Original Hamaca Crude Oil | Reaction under nitrogen | Reaction under methane |
|---|---|---|---|
| 30 | 640,000 | 95,000 | 52,000 |
| 40 | 350,000 | 33,000 | 9,100 |
| 60 | 6100 | 8,800 | 1,100 |
| 80 | 1100 | 950 | 740 |

Figure 3:
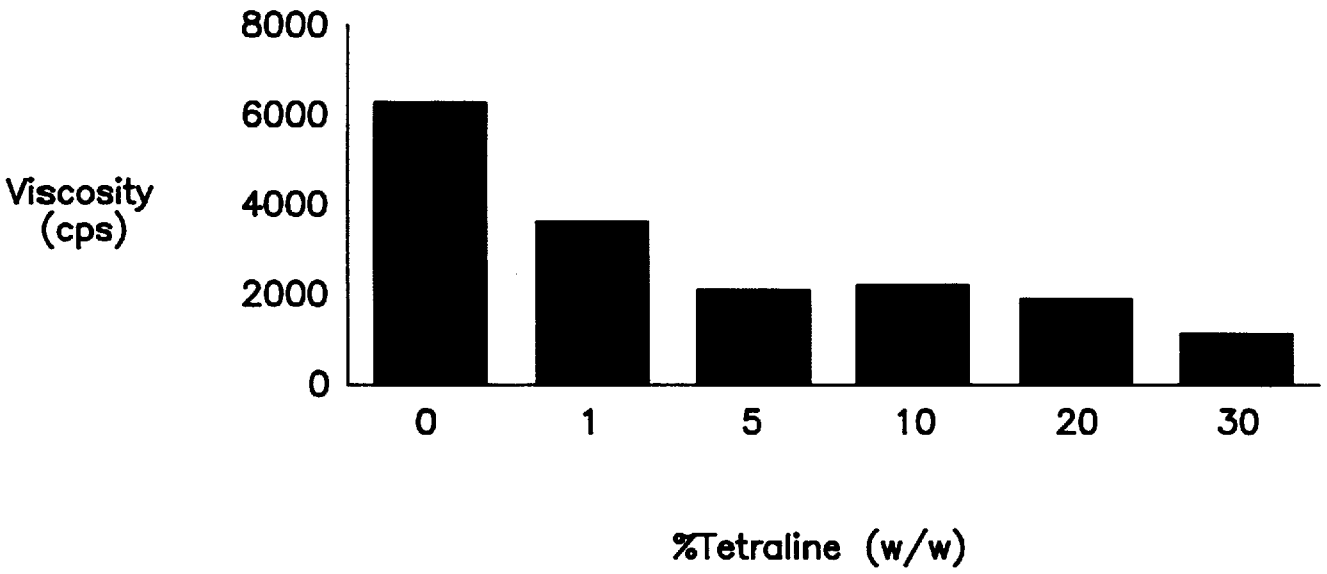
FIG. 3 is a graph illustrating the improved viscosity obtained by the presence of a hydrogen donor.
Figure 4:
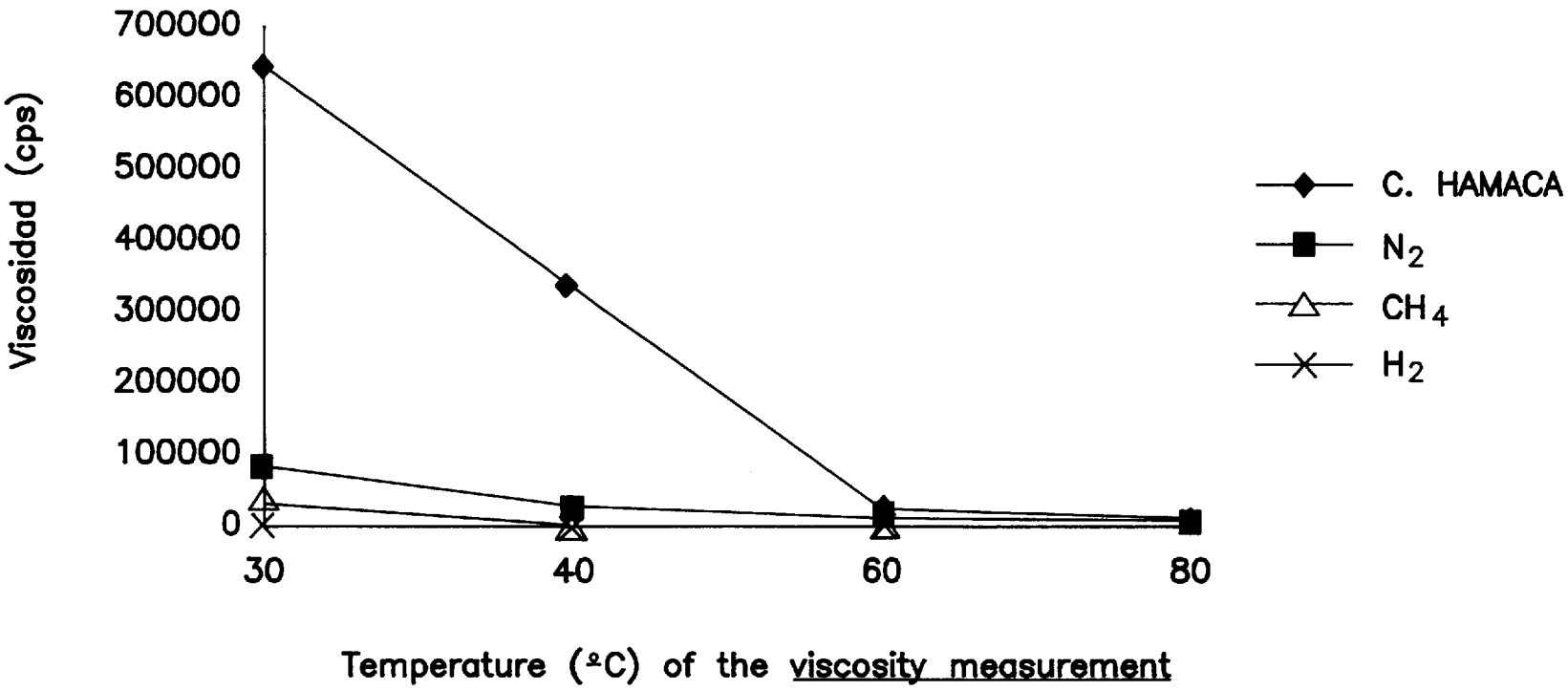
FIG. 4 is a graph illustrating the improved viscosity obtained as a result of the presence of methane in the down hole hydroconversion process.

As can clearly be seen from Table 3 and FIG. 3 methane has a positive effect on the viscosity of the crude oil process in accordance with the present invention.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. In a well formation comprising crude oil, methane and a mineral formation, a down hole hydroconversion process for improving the crude oil viscosity comprising the steps of:

analyzing a well in order to determine: (1) the concentration of crude oil in the well with respect to the mineral formation, and (2) the amount of $CH_4$ present in the well;

comparing the amount of $CH_4$ in the well with the concentration of crude oil in order to determine the sufficiency of $CH_4$ for carrying out the hydroconversion of the crude down hole in the well;

feeding down hole to the well a mixture comprising steam, hydrogen donor, and, if necessary, $CH_4$ so as to obtain down hole in the well a concentration of hydrogen in an amount of at least about 0.15 moles per Kg of crude oil, a concentration of methane in an amount of at least about 0.06 moles per Kg of crude oil, and sufficient steam to raise the temperature down hole of the well to at least about 250° C. such that the crude oil is subjected to hydroconversion in the presence of the hydrogen donor, the methane, the steam and the mineral formation so as to produce an upgraded crude oil; and recovering the upgraded crude oil from the well wherein the viscosity of the crude oil is decreased and the API° is increased.

2. A process according to claim 1 including feeding $CH_4$ down hole to the well so as to obtain a concentration of methane in an amount of between about 0.40 moles to 500 moles of methane per Kg of crude oil.

3. A process according to claim 1 including feeding $CH_4$ down hole to the well so as to obtain a concentration of methane in an amount of between about 1.0 moles to 50.0 moles of methane per Kg of crude oil.

4. A process according to claim 1 including feeding hydrogen donor down hole to the well so as to obtain a concentration of hydrogen donor in an amount of between about 0.15 moles to 20.0 moles of hydrogen donor per Kg of crude oil.

5. A process according to claim 1 including feeding hydrogen donor down hole to the well so as to obtain a concentration of hydrogen donor in an amount of between about 1.12 moles to 12.0 moles of hydrogen donor per Kg of crude oil.

6. A process according to claim 1 wherein the mineral formation contains between about 50 to 90 wt % quartz, between 1.4 to 10.5 wt % iron, between 1 to 15 wt % aluminum and between 1 to 15 wt % calcium.

7. A process according to claim 1 including the step of feeding the steam down hole to the well so as to raise the temperature down hole of the well to between 175° C. and 350° C.

8. A process according to claim 1 including the step of feeding the steam down hole to the well so as to raise the temperature down hole of the well to between 280° C. and 320° C.

9. A process according to claim 6 wherein the iron is selected from a group of iron compounds consisting of FeO, $Fe_2O_3$, $Fe_3O_4$, $FeSO_4$, $Fe_2(SO_4)_3$ and mixtures thereof.

* * * * *